US009506225B2

(12) United States Patent
Kim

(10) Patent No.: US 9,506,225 B2
(45) Date of Patent: Nov. 29, 2016

(54) ACTUATOR DISPLACEMENT MEASUREMENT SYSTEM IN ELECTRONIC HYDRAULIC SYSTEM OF CONSTRUCTION EQUIPMENT

(75) Inventor: Ji-Yun Kim, Changwon-si (KR)

(73) Assignee: VOLVO CONSTRUCTION EQUIPMENT AB, Eskilstuna (SE)

( * ) Notice: Subject to any disclaimer, the term of this patent is extended or adjusted under 35 U.S.C. 154(b) by 442 days.

(21) Appl. No.: 14/349,153

(22) PCT Filed: Oct. 11, 2011

(86) PCT No.: PCT/KR2011/007534
§ 371 (c)(1),
(2), (4) Date: Apr. 2, 2014

(87) PCT Pub. No.: WO2013/054954
PCT Pub. Date: Apr. 18, 2013

(65) Prior Publication Data
US 2014/0230643 A1 Aug. 21, 2014

(51) Int. Cl.
*E02F 9/00* (2006.01)
*E02F 9/26* (2006.01)
(Continued)

(52) U.S. Cl.
CPC ..... *E02F 9/265* (2013.01); *E02F 9/2095* (2013.01); *E02F 9/2271* (2013.01);
(Continued)

(58) Field of Classification Search
CPC ... E02F 9/265; E02F 9/2095; F15B 15/2838; F15B 2211/50518; F15B 2211/30515; F15B 15/2807; F15B 2211/7656
USPC ..... 60/363, 426, 428, 433, 473, 476, 447, 60/449, 468
See application file for complete search history.

(56) References Cited

U.S. PATENT DOCUMENTS 5,684,694 A * 11/1997 Ishino ..... F16H 47/04 475/76
2006/0064971 A1* 3/2006 Reedy ..... F15B 15/2838 60/363

(Continued)

FOREIGN PATENT DOCUMENTS

DE 102009023168 A1 12/2010
JP 2002323005 A 11/2002
JP 2008151299 A 7/2008

(Continued)

OTHER PUBLICATIONS

European Search Report mailed May 22, 2015 for Application No. 11873826.9.

(Continued)

*Primary Examiner* — Michael Leslie
*Assistant Examiner* — Dustin T Nguyen
(74) *Attorney, Agent, or Firm* — Hauptman Ham, LLP

(57) ABSTRACT

An actuator displacement measuring system in an electro-hydraulic system for a construction machine is disclosed, which can detect an actuator displacement using the characteristics of an electro-hydraulic system. The actuator displacement measuring system includes controlling driving of an electric motor, determining whether the electric motor is driven, determining whether a set pressure value of a relief valve is larger than or equal to a measured pressure value of the hydraulic system if a displacement value of an actuator that is always detected deviates from a zero value of a reference position, setting the actuator displacement value to a previous value if a pressure value of the hydraulic system is larger than or equal to a pressure value of a relief valve and calculating the actuator displacement value using a rotating speed of the electric motor.

5 Claims, 2 Drawing Sheets

(51) Int. Cl.

| | |
|---|---|
| ***E02F 9/22*** | (2006.01) |
| ***F15B 15/28*** | (2006.01) |
| ***F15B 21/08*** | (2006.01) |
| ***E02F 9/20*** | (2006.01) |

(52) U.S. Cl.
CPC ..... *F15B 15/2838* (2013.01); *F15B 21/08* (2013.01); *F15B 15/2807* (2013.01); *F15B 2211/20515* (2013.01); *F15B 2211/20561* (2013.01); *F15B 2211/27* (2013.01); *F15B 2211/30515* (2013.01); *F15B 2211/50518* (2013.01); *F15B 2211/633* (2013.01); *F15B 2211/6309* (2013.01); *F15B 2211/6336* (2013.01); *F15B 2211/6651* (2013.01); *F15B 2211/7656* (2013.01)

(56) References Cited

U.S. PATENT DOCUMENTS

| | | | | |
|---|---|---|---|---|
| 2010/0308179 | A1 | 12/2010 | Babando et al. | |
| 2013/0048117 | A1* | 2/2013 | Opdenbosch ..... | E02F 9/2217 137/565.01 |

FOREIGN PATENT DOCUMENTS

| | | | |
|---|---|---|---|
| KR | 200377929 | Y1 | 3/2005 |
| WO | 2007015814 | A2 | 2/2007 |

OTHER PUBLICATIONS

International Search Report mailed May 17, 2012 for PCT/KR2011/007534.

* cited by examiner

ACTUATOR DISPLACEMENT MEASUREMENT SYSTEM IN ELECTRONIC HYDRAULIC SYSTEM OF CONSTRUCTION EQUIPMENT

CROSS REFERENCE TO RELATED APPLICATION

This application is the National Phase application of International Application No. PCT/KR2011/007534 filed on Oct. 11, 2011, which is incorporated herein by reference in its entirety.

TECHNICAL FIELD

The present invention relates to an actuator displacement measuring system in an electro-hydraulic system for a construction machine. More particularly, the present invention relates to an actuator displacement measuring system in an electro-hydraulic system for a construction machine, which can control an actuator or a displacement of the actuator through detection of the displacement of the actuator (hydraulic cylinder or the like) using the characteristics of the electro-hydraulic system that drives a hydraulic pump using an electric motor as a power source.

BACKGROUND ART

In general, in a hydraulic excavator that adopts a hydraulic system to drive an actuator, such as a boom cylinder, by means of hydraulic fluid discharged from a hydraulic pump that is driven by an engine, the displacement of a boom cylinder or the like is measured by a displacement sensor, an AD converter, and a data acquisition system (DAQ), which are separately mounted on the excavator. Accordingly, the number of components of a measuring device for detecting the displacement of the actuator is increased to cause the increase of the manufacturing cost, and it becomes difficult to precisely control the driving of the actuator to deteriorate workability.

DISCLOSURE

Technical Problem

Therefore, the present invention has been made to solve the above-mentioned problems occurring in the related art, and one embodiment of the present invention is related to an actuator displacement measuring system in an electro-hydraulic system for a construction machine, which can simplify the measurement of a cylinder displacement without the necessity of a displacement sensor and can precisely control the driving of an electro-hydraulic system through detection of the displacement of a hydraulic cylinder using the characteristics (e.g., a rotating speed of an electric motor, pressure of a hydraulic cylinder, and capacity of a hydraulic pump) of the hydraulic system.

Technical Solution

In accordance with an aspect of the present invention, there is provided an actuator displacement measuring system in an electro-hydraulic system for a construction machine, having an electric motor, a hydraulic pump driven by the electric motor, a hydraulic actuator connected to the hydraulic pump, a load holding valve installed in a flow path between the hydraulic pump and the actuator, a relief valve installed in a branch flow path connected in parallel to the flow path, and a controller controlling driving of the electric motor, the actuator displacement measuring system including controlling the driving of the electric motor according to a control signal from the controller; determining whether the electric motor is driven, and if the electric motor is driven, calculating a flow rate of the hydraulic pump; determining whether a displacement value of the actuator that is always detected by a detection signal input from a position detection sensor to the controller deviates from a zero value that is set as a reference position; determining whether a set pressure value of the relief valve is larger than or equal to a measured pressure value of the hydraulic system if the actuator displacement value deviates from the set zero value; setting the actuator displacement value to a previous value if the pressure value of the hydraulic system is larger than or equal to the pressure value of the relief valve, and calculating the actuator displacement value using a rotating speed of the electric motor, a sectional area of the actuator, and a supply flow rate of the hydraulic pump if the pressure value of the hydraulic system is smaller than the pressure value of the relief valve; and finishing the calculation after storing the actuator displacement value calculated up to now in the controller if a power-off request of the hydraulic system is input, and moving to an initial stage if the power-off request of the hydraulic system is not input.

Preferably, the hydraulic actuator may be a hydraulic cylinder.

The actuator displacement measuring system according to the aspect of the present invention may further include a first sensor for sensing positions that is mounted on a piston of the hydraulic cylinder, and second and third sensors for sensing positions that are mounted on a tube of the hydraulic cylinder during a stroke end of the hydraulic cylinder, wherein an accumulated error of displacement values of the hydraulic cylinder that are calculated by detection signals input from the second and third sensors to the controller is removed, and the displacement value of the hydraulic cylinder is reset to a zero value when the first sensor coincides with any one of the second and third sensors.

The displacement value D of the hydraulic cylinder may be calculated by $D=\int V dt=\int (Q/A) dt$ (where, V is a driving speed of the hydraulic cylinder, Q is a flow rate of the hydraulic pump, and A is a sectional area of the hydraulic cylinder).

The hydraulic pump may be composed of a fixed displacement hydraulic pump.

Advantageous Effect

The actuator displacement measuring system in an electro-hydraulic system for a construction machine according to the aspect of the present invention as configured above has the following advantages.

Since the displacement of the hydraulic cylinder is detected using the characteristics of the electro-hydraulic system, a separate displacement sensor is unnecessary, and thus the hydraulic cylinder displacement measuring device can be simplified. Further, due to the accuracy of the values of displacement detection of the hydraulic cylinder, the driving of the hydraulic cylinder can be precisely controlled to heighten the work efficiency.

BRIEF DESCRIPTION OF THE DRAWINGS

The above objects, other features and advantages of the present invention will become more apparent by describing the preferred embodiments thereof with reference to the accompanying drawings, in which.

DESCRIPTION OF REFERENCE NUMERALS IN THE DRAWING

Figure 1:
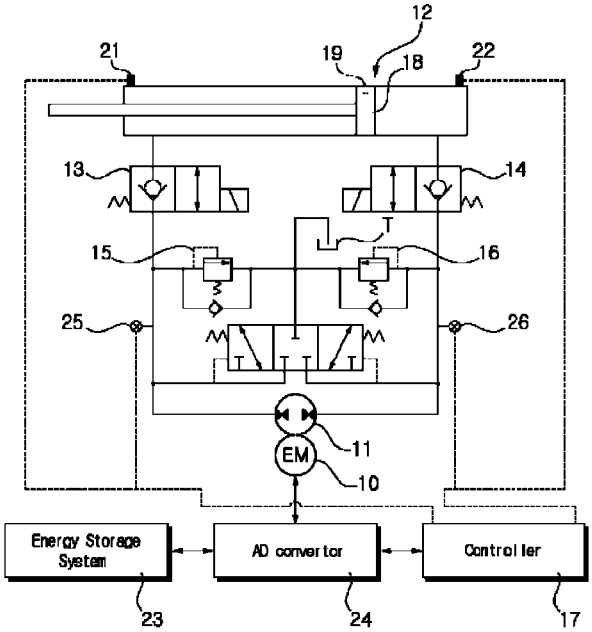
FIG. 1 is a schematic diagram of an actuator displacement measuring system in an electro-hydraulic system for a construction machine according to an embodiment of the present invention.

10: electric motor
11: hydraulic pump
13, 14: load holding valve
15, 16: relief valve
17: controller
18: hydraulic cylinder piston
19: first sensor for detecting positions
20: hydraulic cylinder tube
21: second sensor for detecting positions
22: third sensor for detecting positions

BEST MODE

Hereinafter, preferred embodiments of the present invention will be described in detail with reference to the accompanying drawings. The matters defined in the description, such as the detailed construction and elements, are nothing but specific details provided to assist those of ordinary skill in the art in a comprehensive understanding of the invention, and the present invention is not limited to the embodiments disclosed hereinafter.

Figure 2:
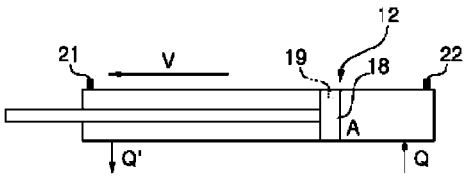
FIG. 2 is a view explaining displacement measurement of an actuator in an actuator displacement measuring system in an electro-hydraulic system for a construction machine according to an embodiment of the present invention.
Figure 3:
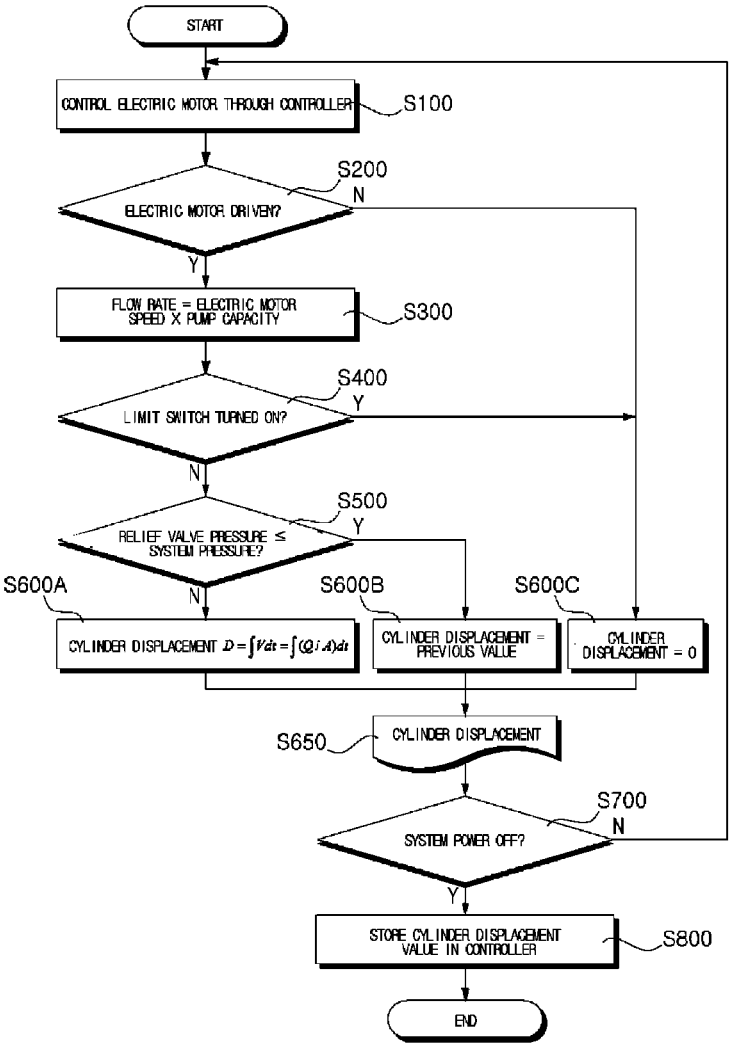
FIG. 3 is a flowchart explaining the operation of an actuator displacement measuring system in an electro-hydraulic system for a construction machine according to an embodiment of the present invention.

According to an embodiment of the present invention as illustrated in FIGS. 1 to 3, an actuator displacement measuring system in an electro-hydraulic system for a construction machine, having an electric motor 10, a hydraulic pump 11 driven by the electric motor 10, a hydraulic actuator (hereinafter referred to as a "hydraulic cylinder") 12 connected to the hydraulic pump 11, a load holding valve 13, 14 installed in a flow path between the hydraulic pump 11 and the hydraulic cylinder 12, a relief valve 15, 16 installed in a branch flow path connected in parallel to the flow path, and a controller 17 controlling driving of the electric motor 10, the actuator displacement measuring system includes controlling the driving of the electric motor 10 according to a control signal from the controller 17 (S100); determining whether the electric motor 10 is driven (S200); if the electric motor 10 is driven, calculating a flow rate Q of the hydraulic pump 11 (S300); determining whether a displacement value of the hydraulic cylinder 12 that is always detected by a detection signal input from second and third sensors 21 and 22 for sensing positions to the controller 17 deviates from a zero value (initial value) that is set as a reference position (S400); determining whether a set pressure value of the relief valve 15, 16 is larger than or equal to a measured pressure value of the hydraulic system if the displacement value of the hydraulic cylinder 12 deviates from the set zero value (S500); setting the displacement value of the hydraulic cylinder 12 to a previous value if the pressure value of the hydraulic system is larger than or equal to the pressure value of the relief valve 15, 16 (S600B), and calculating the displacement value of the hydraulic cylinder 12 using a rotating speed of the electric motor 11, a sectional area of the hydraulic cylinder 12, and a supply flow rate of the hydraulic pump 11 if the pressure value of the hydraulic system is smaller than the pressure value of the relief valve 15, 16 (S600A); storing the displacement value of the hydraulic cylinder 12 (S650); determining a power-off state of the hydraulic system (S700); and finishing the calculation after storing the displacement value of the hydraulic cylinder 12 calculated up to now in the controller 17 if a power-off request of the hydraulic system is input (S800), and moving to an initial stage if the power-off request of the hydraulic system is not input.

According to the actuator displacement measuring system according to an embodiment of the present invention, an accumulated error of displacement values of the hydraulic cylinder 12, which are calculated by detection signals input from first to third sensors 19, 21, and 22 for sensing positions that are mounted on a hydraulic cylinder tube 20 to the controller 17 during a stroke end of a piston 18 of the hydraulic cylinder 12, is removed, and the displacement value of the hydraulic cylinder 12 is reset to a zero value when the first sensor 19 coincides with any one of the second and third sensors 21 and 22.

The displacement value D of the hydraulic cylinder 12 is calculated by $D=\int Vdt=\int(Q/A)dt$ (where, V is a driving speed of the hydraulic cylinder, Q is a flow rate of the hydraulic pump, and A is a sectional area of the hydraulic cylinder).

The hydraulic pump 11 may be composed of a fixed displacement hydraulic pump.

In the drawing, unexplained reference numeral 23 denotes an energy storage system, 24 denotes an AD converter, and 25 and 26 denote pressure sensors detecting the pressure of the hydraulic system and transmitting a detection signal to the controller 17.

Hereinafter, a use example of the actuator displacement measuring system in an electro-hydraulic system for a construction machine according to an embodiment of the present invention will be described in detail.

As illustrated in FIGS. 1 to 3, electric energy of an AC voltage of the energy storage system 23 is converted into a DC voltage by the AD converter 24, and the converted DC voltage is supplied to the electric motor 10 to drive the electric motor 10. In this case, the electric motor 10 is driven by a control signal from the controller 17, and the electric motor 10 drives the hydraulic pump 11.

The flow rate Q that is supplied from the hydraulic cylinder 12 is calculated using a speed feedback value of the electric motor 10 that is input to the controller 17 and a capacity value of the hydraulic pump 11. That is, Q=(electric motor speed)×(pump displacement)=A (cylinder area)×V (cylinder speed).

In this case, the speed V of the hydraulic cylinder 12 is determined from the correlation between the supply flow rate Q of the hydraulic pump 11 and the sectional area A of the hydraulic cylinder 12.

On the other hand, the displacement D of the hydraulic cylinder 12 is calculated by an equation $D=\int Vdt=\int(Q/A)dt$. Accordingly, if the controller 17 receives an input of the speed feedback value of the electric motor 10, the displacement of the hydraulic cylinder 12 can be calculated.

Hereinafter, a process of calculating the displacement of the hydraulic cylinder 12 will be described with reference to FIG. 3.

As in S100, the driving of the electric motor 10 is controlled by the control signal from the controller 17.

As in S200, it is determined whether the electric motor 10 is driven, and if the electric motor 10 is driven, the flow rate of the hydraulic pump 11 is calculated (S300), while if the electric motor 10 is not driven, the process proceeds to S600C (since the electric motor 10 is in an off state, the hydraulic fluid is not supplied from the hydraulic pump 11, and the displacement D of the hydraulic cylinder 12 is kept "0").

As in S300, the supply flow rate Q of the hydraulic pump 11 is calculated using the speed value of the electric motor 10 (the rotating speed of the electric motor is detected by a rotating speed detector (not illustrated)) and the capacity value of the hydraulic pump 11.

As in S400, the detection signals that are detected by the second and third sensors 21 and 22 for sensing positions mounted on the hydraulic cylinder 12 are always input to the controller 17. If the first sensor 19 for sensing positions that is mounted on the hydraulic cylinder piston 18 comes in contact with any one of the second and third sensors 21 and 22 for sensing positions that are mounted on the hydraulic cylinder tube 20 (if a limit switch is in an on state), the hydraulic cylinder piston 18 is in the stroke end state, and the controller 17 sets the displacement D of the hydraulic cylinder 12 to a zero value (initial value). Through this, the accumulated error of displacement values of the hydraulic cylinder 12, which is continuously accumulated due to the use of an integrator in a process of calculating the displacement of the hydraulic cylinder 12, can be removed. That is, by resetting the initial value at a specific position, the precision in measuring the displacement of the hydraulic cylinder 12 can be heightened.

If the limit switch is in an on state, the process proceeds to S600C, while if the limit switch is in an off state (if the first sensor 19 for sensing positions does not come in contact with the second and third sensors 21 and 22 for sensing positions), the process proceeds to S50.

As in S500, in the case where the limit switch is turned off, the set pressure value of the relief valve 15, 16 is compared with the pressure value of the hydraulic system that is detected by the pressure sensor 25, 26. If the pressure value of the hydraulic system is larger than or equal to the pressure value of the relief valve 15, 16, the process proceeds to S600B, while if the pressure value of the hydraulic system is smaller than the pressure value of the relief valve 15, 16, the process proceeds to S600A.

As in S600B, in the case where the pressure value of the hydraulic system is larger than or equal to the pressure value of the relief valve 15, 16, the displacement value of the hydraulic cylinder 12 is set to the previous value. This is because when the detected pressure of the hydraulic system is higher than the set pressure of the relief valve 15, 16, all the hydraulic fluid that is discharged from the hydraulic pump 11 returns to a hydraulic tank T via the relief valve 15, 16, and thus the hydraulic cylinder 12 is not driven. Accordingly, by keeping the displacement value of the hydraulic cylinder 12 as the previous value, the displacement value of the hydraulic cylinder 12 can be calculated.

As in S600A, if the measured pressure value of the hydraulic system is smaller than the set pressure value of the relief valve 15, 16, the displacement D of the hydraulic cylinder 12 is calculated using the rotating speed of the electric motor 10, the sectional area of the hydraulic cylinder 12, and the supply flow rate of the hydraulic pump 11.

That is, the displacement value D of the hydraulic cylinder 12 can be calculated by the equation $D=\int V dt=\int(Q/A)dt$ (where, V is the driving speed of the hydraulic cylinder, Q is the flow rate of the hydraulic pump, and A is the sectional area of the hydraulic cylinder).

As in S650, the displacement value of the hydraulic cylinder 12 is stored.

As in S700, it is determined whether the hydraulic system is in a power-off state, and if a power-off request of the hydraulic system is input, the process proceeds to S800, while if the power-off request of the hydraulic system is not input, the process proceeds to the initial stage (refer to S100).

As in S800, if the power-off of the hydraulic system is requested, the calculation is finished after the displacement value of the hydraulic cylinder 12 calculated up to now is stored in the controller 17. Through this, if the power of the equipment hydraulic system is turned on thereafter, the displacement of the hydraulic cylinder 12 can be re-calculated based on the displacement value of the hydraulic cylinder 12 stored in the controller 17.

INDUSTRIAL APPLICABILITY

As apparent from the above description, according to the actuator displacement measuring system in an electro-hydraulic system for a construction machine according to an embodiment of the present invention as described above, the displacement of the hydraulic cylinder is detected using the characteristics of the electro-hydraulic system, and thus a separate displacement sensor is unnecessary. Further, due to the accuracy of the values of displacement detection of the hydraulic cylinder, the driving of the hydraulic cylinder can be precisely controlled.

The invention claimed is:

1. An actuator displacement measuring system in an electro-hydraulic system for a construction machine, including an electric motor, a hydraulic pump driven by the electric motor, a hydraulic actuator connected to the hydraulic pump, a load holding valve installed in a flow path between the hydraulic pump and the actuator, a relief valve installed in a branch flow path connected in parallel to the flow path, and a controller controlling driving of the electric motor, the actuator displacement measuring system comprising:

controlling the driving of the electric motor according to a control signal from the controller;

determining whether the electric motor is driven, and if the electric motor is driven, calculating a flow rate of the hydraulic pump;

determining whether a displacement value of the actuator that is always detected by a detection signal input from a position detection sensor to the controller deviates from a zero value that is set as a reference position;

determining whether a set pressure value of the relief valve is larger than or equal to a measured pressure value of the hydraulic system if the actuator displacement value deviates from the set zero value;

setting the actuator displacement value to a previous value if the pressure value of the hydraulic system is larger than or equal to the pressure value of the relief valve, and calculating the actuator displacement value using a rotating speed of the electric motor, a sectional area of the actuator, and a supply flow rate of the hydraulic pump if the pressure value of the hydraulic system is smaller than the pressure value of the relief valve; and finishing the calculation after storing the actuator displacement value calculated up to now in the controller if a power-off request of the hydraulic system is input, and moving to an initial stage if the power-off request of the hydraulic system is not input.

2. The actuator displacement measuring system according to claim 1, wherein the hydraulic actuator is a hydraulic cylinder.

3. The actuator displacement measuring system according to claim 2, further comprising a first sensor for sensing positions that is mounted on a piston of the hydraulic cylinder, and second and third sensors for sensing positions that are mounted on a tube of the hydraulic cylinder during a stroke end of the hydraulic cylinder, wherein an accumulated error of displacement values of the hydraulic cylinder that are calculated by detection signals input from the second and third sensors to the controller is removed, and the displacement value of the hydraulic cylinder is reset to a zero value when the first sensor coincides with any one of the second and third sensors.

4. The actuator displacement measuring system according to claim 3, wherein the displacement value D of the hydraulic cylinder is calculated by $D=\int Vdt=\int(Q/A)dt$ where, V is a driving speed of the hydraulic cylinder, Q is a flow rate of the hydraulic pump, and A is a sectional area of the hydraulic cylinder.

5. The actuator displacement measuring system according to claim 1, wherein the hydraulic pump is composed of a fixed displacement hydraulic pump.

* * * * *